US011456563B2

(12) United States Patent
Messuri et al.

(10) Patent No.: US 11,456,563 B2
(45) **Date of Patent: *Sep. 27, 2022**

(54) ELECTROMAGNETIC SHIELD FOR AN ELECTRICAL TERMINAL WITH INTEGRAL SPRING CONTACT ARMS

(71) Applicant: Aptiv Technologies Limited, St. Michael (BB)

(72) Inventors: Michael D. Messuri, Canfield, OH (US); John R. Morello, Warren, OH (US); James M. Rainey, Warren, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

This patent is subject to a terminal disclaimer.

(21) Appl. No.: 17/109,856

(22) Filed: Dec. 2, 2020

(65) Prior Publication Data

US 2021/0091513 A1 Mar. 25, 2021

Related U.S. Application Data

(63) Continuation of application No. 16/555,245, filed on Aug. 29, 2019, now Pat. No. 10,923,861.
(Continued)

(51) Int. Cl.
*H01R 13/6582* (2011.01)
*H01R 4/48* (2006.01)
(Continued)

(52) U.S. Cl.
CPC ..... *H01R 13/6582* (2013.01); *H01R 4/16* (2013.01); *H01R 4/48* (2013.01); *H01R 13/508* (2013.01); *H01R 13/635* (2013.01)

(58) Field of Classification Search
CPC ..... H01R 13/6461; H01R 13/6463; H01R 13/6581; H01R 13/6582; H01R 13/6592;
(Continued)

(56) References Cited

U.S. PATENT DOCUMENTS 2,942,231 A * 6/1960 Cornell, Jr. ..... H01R 13/111 439/847
4,812,127 A 3/1989 Hernandez
(Continued)

FOREIGN PATENT DOCUMENTS

CN 102870280 A 1/2013
CN 203386995 U 1/2014
(Continued)

OTHER PUBLICATIONS

European Search Report for Application No. 19203501, European Patent Office, Jan. 16, 2020.
(Continued)

*Primary Examiner* — Marcus E Harcum
(74) *Attorney, Agent, or Firm* — Billion & Armitage

(57) ABSTRACT

An electromagnetic terminal shield includes a shield body formed of sheet metal having a connector opening configured to receive a corresponding mating terminal shield and a cable opening configured to receive a wire cable and a plurality of cantilevered spring arms integrally formed with the shield body having fixed ends attached to the connector opening and free ends disposed within a shield cavity defined by the shield body. Each spring arm in the plurality of cantilevered spring arms has a free end that is in contact with the inner surface of the shield body within the shield cavity. A process for manufacturing an electromagnetic terminal shield and the electromagnetic terminal shield produced by this process are also presented herein.

12 Claims, 4 Drawing Sheets

Related U.S. Application Data

(60) Provisional application No. 62/747,824, filed on Oct. 19, 2018.

(51) Int. Cl.
*H01R 13/635* (2006.01)
*H01R 13/508* (2006.01)
*H01R 4/16* (2006.01)

(58) Field of Classification Search
CPC ..... H01R 13/6583; H01R 13/65825; H01R 13/6589; H01R 13/6596; H01R 13/65915; H01R 13/65917; H01R 13/111; H01R 13/113; H01R 13/114; H01R 13/508; H01R 13/635; H01R 43/02; H01R 4/16; H01R 4/48
USPC ..... 439/748, 843, 847, 607.17, 607.04
See application file for complete search history.

(56) References Cited

U.S. PATENT DOCUMENTS 4,812,137 A 3/1989 Wilson et al.
4,936,795 A 6/1990 Kawai et al.
4,938,714 A 7/1990 Kawai et al.
5,509,823 A * 4/1996 Harting ..... H01R 12/57 439/607.17
6,203,372 B1 * 3/2001 Matsumoto ..... H01R 13/6593 439/585
6,299,489 B1 10/2001 Phillips et al.
6,479,622 B1 11/2002 Gross et al.
6,645,011 B2 * 11/2003 Schneider ..... H01R 13/6277 439/578
6,666,720 B1 * 12/2003 Reisinger ..... H01R 13/6594 439/607.13
7,097,505 B1 8/2006 Shanahan et al.
7,150,653 B1 12/2006 Mason
7,794,274 B2 9/2010 Phillips
7,828,609 B2 * 11/2010 Li ..... H01R 13/33 439/843
7,997,932 B2 * 8/2011 Xu ..... H01R 12/707 439/607.04
8,827,754 B2 * 9/2014 Lee ..... H01R 13/187 439/845
9,004,946 B2 4/2015 Hoeppner
9,362,631 B2 6/2016 Listing et al.
9,413,115 B1 8/2016 Henry
9,667,000 B1 5/2017 Morello et al.
9,762,001 B2 9/2017 Morello et al.
9,960,550 B2 5/2018 Ensley et al.
10,008,786 B2 6/2018 Brantingham
2002/0142636 A1 10/2002 Murr et al.
2008/0233797 A1 9/2008 Hsu et al.
2009/0269981 A1 * 10/2009 Haruna ..... H01R 13/6582 439/607.04
2010/0035459 A1 2/2010 Briant et al.
2013/0034993 A1 * 2/2013 Szczesny ..... H01R 13/6587 439/607.17
2013/0084741 A1 * 4/2013 Pabst ..... H01R 43/20 439/607.17
2014/0073185 A1 * 3/2014 Siahaan ..... H01R 13/504 439/607.58
2015/0111430 A1 * 4/2015 Kao ..... H01R 13/6592 439/607.55
2015/0303623 A1 * 10/2015 Kao ..... H01R 24/60 439/607.04
2016/0020541 A1 1/2016 Takamura
2016/0126654 A1 5/2016 Hashiguchi et al.
2016/0172791 A1 * 6/2016 Fan ..... H01R 13/6593 439/607.05
2016/0380387 A1 * 12/2016 Wu ..... H01R 13/6658 439/95
2017/0373444 A1 12/2017 Hu et al.
2018/0054012 A1 2/2018 Zhu et al.
2018/0164519 A1 6/2018 Takai et al.
2018/0375233 A1 12/2018 Morello et al.
2019/0067880 A1 2/2019 Zhang et al.
2019/0199008 A1 6/2019 Kanemura et al.
2019/0199013 A1 6/2019 Kanemura et al.
2019/0288459 A1 9/2019 Jin et al.
2020/0119495 A1 4/2020 Bredbeck et al.

FOREIGN PATENT DOCUMENTS

CN 108039598 A 5/2018
CN 110495055 B * 12/2020 ..... H01R 13/111
DE 102012103259 A 10/2013
DE 112014005274 B4 * 1/2021 ..... H01R 4/183
EP 2843774 A1 3/2015
EP 2843774 B1 5/2016
JP 61184285 A 8/1986
JP 2015524152 A 8/2015

OTHER PUBLICATIONS

Chinese Search Report for CN Application No. 201910966622.2, dated Oct. 9, 2020, 8 pages.
Chinese Office Action for CN Application No. 201910966622, dated Jan. 13, 2021, 6 pages.
Korean Office Action for KR Application No. 10-2019-0127426, dated Jan. 28, 2021, 5 pages.
Notice of Decision to Grant for Chinese Application No. 201910966622.2, dated Apr. 14, 2021, 8 pages.

* cited by examiner

ELECTROMAGNETIC SHIELD FOR AN ELECTRICAL TERMINAL WITH INTEGRAL SPRING CONTACT ARMS

CROSS-REFERENCE TO RELATED APPLICATION

This application is a continuation application and claims the benefit of co-pending U.S. patent application Ser. No. 16/555,245 filed Aug. 29, 2019, which claimed the benefit of U.S. Provisional Patent Application No. 62/747,824 filed Oct. 19, 2018, the entire disclosure of each of which is hereby incorporated herein by reference.

TECHNICAL FIELD

The invention generally relates to an electromagnetic shield for an electrical terminal, particularly to an electromagnetic shield with spring contact arms that are integrally formed with the electromagnetic shield.

BRIEF SUMMARY

According to one or more aspects of the present disclosure, an electromagnetic terminal shield includes a shield body formed of sheet metal having a connector opening configured to receive a corresponding mating terminal shield and a cable opening configured to receive a wire cable and a plurality of cantilevered spring arms integrally formed with the shield body having fixed ends attached to the connector opening and free ends disposed within a shield cavity defined by the shield body. Each spring arm in the plurality of cantilevered spring arms has a free end that is in contact with an inner surface of the shield body within the shield cavity.

In one or more embodiments of the electromagnetic terminal shield according to the previous paragraph, each spring arm in the plurality of cantilevered spring arms is bent toward an inner surface of the shield body within the shield cavity.

In one or more embodiments of the electromagnetic terminal shield according to any one of the previous paragraphs, the plurality of cantilevered spring arms includes a first spring arm, a second spring arm generally parallel to the first spring arm, and a third spring arm generally parallel to the second spring arm and wherein the free ends of the first, second and third spring arms are interconnected by a cross bar that is in contact with the inner surface of the shield body within the shield cavity.

In one or more embodiments of the electromagnetic terminal shield according to any one of the previous paragraphs, each spring arm in the plurality of cantilevered spring arms is opposite another spring arm in the plurality of cantilevered spring arms.

In one or more embodiments of the electromagnetic terminal shield according to any one of the previous paragraphs, the shield body defines a longitudinal seam joint and wherein the seam joint is spot welded near a cable opening.

According to one or more aspects of the present disclosure, a process for manufacturing an electromagnetic terminal shield includes the steps of forming a terminal shield preform from a planar sheet of metal having a plurality of elongate projections extending from one end of the terminal shield preform, folding the plurality of elongate projections toward the terminal shield preform to form a plurality of cantilevered spring arms, and joining distal edges of the terminal preform to form a shield body having a connector opening configured to receive a corresponding mating terminal shield and a cable opening configured to receive a wire cable. The plurality of cantilevered spring arms is integrally formed with the shield body having fixed ends attached to the connector opening and free ends disposed within a shield cavity defined by the shield body. Each spring arm in the plurality of cantilevered spring arms has a free end that is in contact with an inner surface of the shield body within the shield cavity.

In one or more embodiments of the process according to the previous paragraph, the process further includes the step of bending each spring arm in the plurality of cantilevered spring arms toward an inner surface of the shield body within the shield cavity.

In one or more embodiments of the process according to any one of the previous paragraphs, the plurality of cantilevered spring arms includes a first spring arm, a second spring arm generally parallel to the first spring arm, and a third spring arm generally parallel to the second spring arm. The free ends of the first, second and third spring arms are interconnected by a cross bar that is in contact with the inner surface of the shield body within the shield cavity.

In one or more embodiments of the process according to any one of the previous paragraphs, each spring arm in the plurality of cantilevered spring arms is opposite another spring arm in the plurality of cantilevered spring arms.

In one or more embodiments of the process according to any one of the previous paragraphs, the process further includes the step of spot welding a longitudinal seam joint of the shield body near a cable opening of the shield body.

According to one or more aspects of the present disclosure, an electromagnetic terminal shield is manufactured by a process, which includes the steps of includes the steps of forming a terminal shield preform from a planar sheet of metal having a plurality of elongate projections extending from one end of the terminal shield preform, folding the plurality of elongate projections toward the terminal shield preform to form a plurality of cantilevered spring arms, and joining distal edges of the terminal preform to form a shield body having a connector opening configured to receive a corresponding mating terminal shield and a cable opening configured to receive a wire cable. The plurality of cantilevered spring arms is integrally formed with the shield body having fixed ends attached to the connector opening and free ends disposed within a shield cavity defined by the shield body. Each spring arm in the plurality of cantilevered spring arms has a free end that is in contact with an inner surface of the shield body within the shield cavity.

In one or more embodiments of the electromagnetic terminal shield according to the previous paragraph, the process further includes the step of bending each spring arm in the plurality of cantilevered spring arms toward an inner surface of the shield body within the shield cavity.

In one or more embodiments of the electromagnetic terminal shield according to any one of the previous paragraphs, the plurality of cantilevered spring arms includes a first spring arm, a second spring arm generally parallel to the first spring arm, and a third spring arm generally parallel to the second spring arm. The free ends of the first, second and third spring arms are interconnected by a cross bar that is in contact with the inner surface of the shield body within the shield cavity.

In one or more embodiments of the electromagnetic terminal shield according to any one of the previous paragraphs, each spring arm in the plurality of cantilevered spring arms is opposite another spring arm in the plurality of cantilevered spring arms.

In one or more embodiments of the electromagnetic terminal shield according to any one of the previous paragraphs, the process further includes the step of spot welding a longitudinal seam joint of the shield body near a cable opening of the shield body.

BRIEF DESCRIPTION OF THE DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
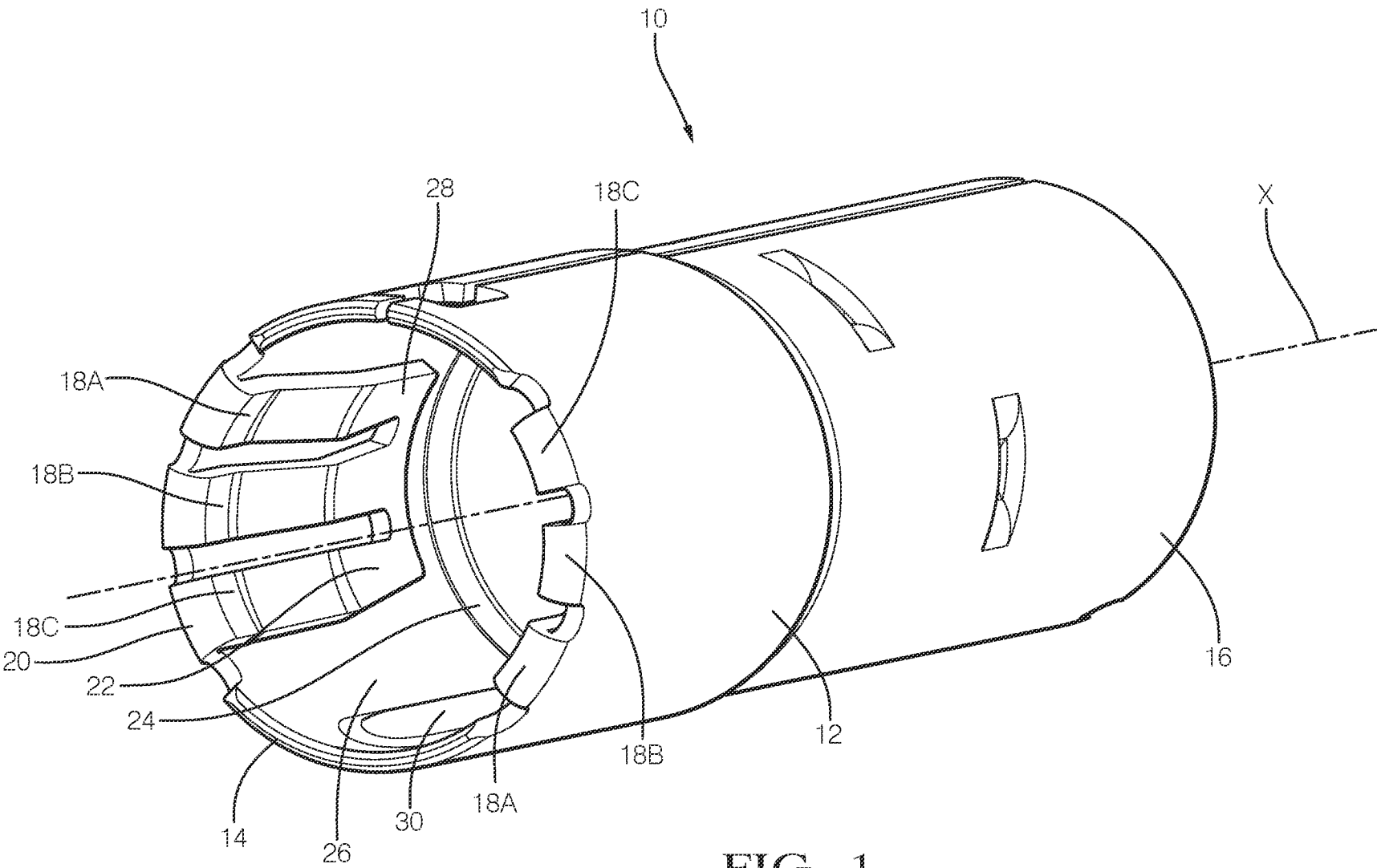
FIG. 1 is a perspective view of an electromagnetic terminal shield having integral spring contact arms, according to one embodiment of the invention.
Figure 2:
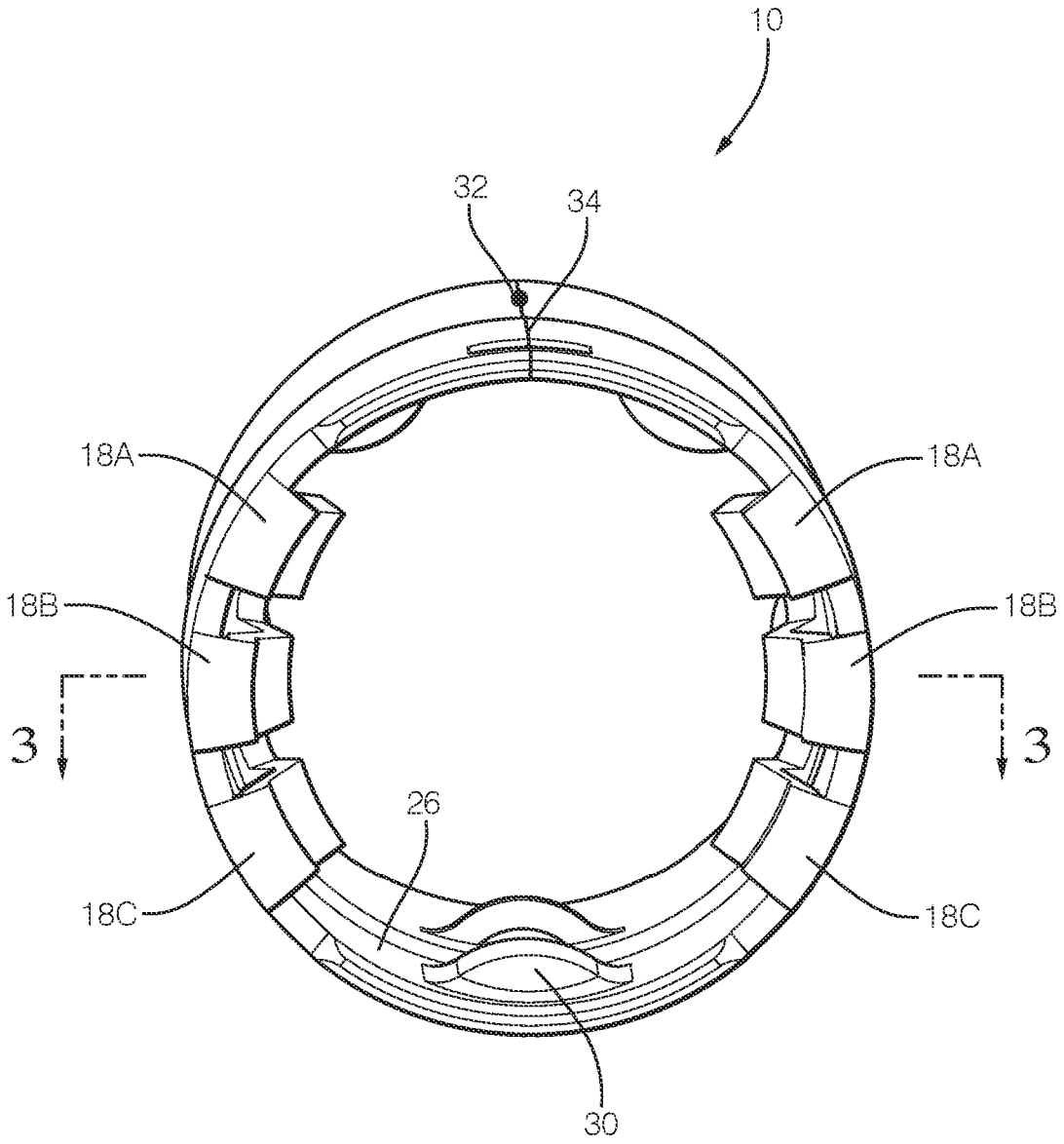
FIG. 2 is an end view of the electromagnetic terminal shield of FIG. 1, according to one embodiment of the invention.
Figure 3:
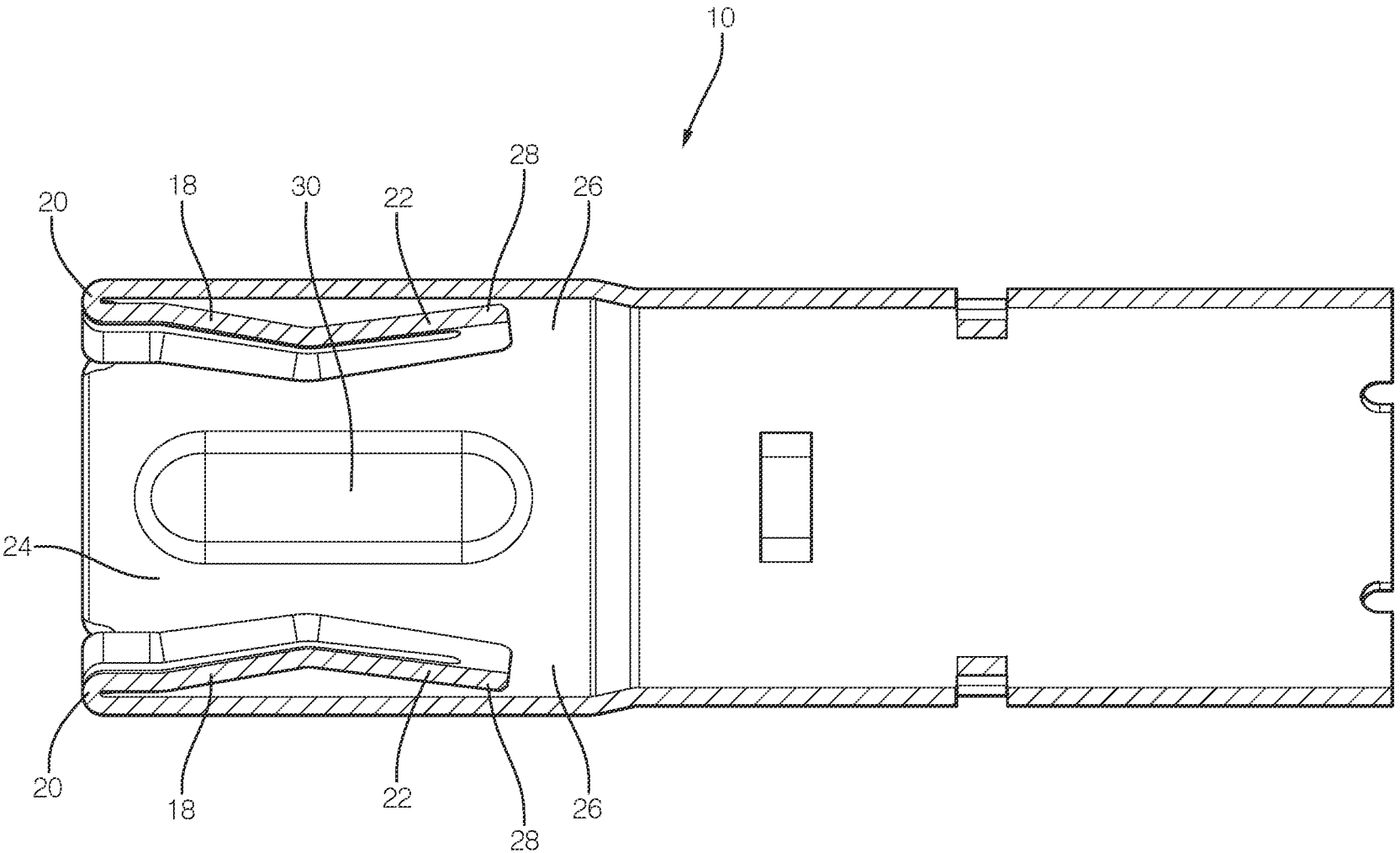
FIG. 3 is cross section side view of the electromagnetic terminal shield of FIG. 1, according to one embodiment of the invention.

FIGS. 1 through 3 illustrate an embodiment of an electromagnetic terminal shield, hereinafter referred to as the shield 10, that is configured to be connected, for example to a shield conductor of a shielded cable (not shown) and provide electromagnetic shielding to an electrical terminal (not shown) connected to an inner conductor of the shielded cable. The shield 10 is configured to receive a corresponding mating electromagnetic terminal shield (not shown) within. The shield 10 includes a shield body 12 that is formed from a planar sheet of metal, such as a tin plated copper-based material. The shield body 12 has a connector opening 14 that is configured to receive the corresponding mating terminal shield and a cable opening 16 that is configured to receive the shielded wire cable. The shielded wire cable is preferably terminated by a ferrule (not shown) that is received within the cable opening 16. The shield 10 also includes a plurality of cantilevered spring arms 18 extending along a longitudinal axis X of the shield body 12 that is integrally formed with the shield body 12 and has fixed ends 20 that are attached to the connector opening 14 and free ends 22 that are disposed within a shield cavity 24 defined by the shield body 12.

As best shown in FIG. 3, each spring arm 18 in the plurality of cantilevered spring arms 18 is bent toward an inner surface 26 of the shield body 12 within the shield cavity 24. The free end 22 of each spring arm 18 in the plurality of cantilevered spring arms 18 is in contact with an inner surface 26 of the shield body 12 within the shield cavity 24.

As best illustrated in FIG. 1, the plurality of cantilevered spring arms 18 includes a first spring arm 18A, a second spring arm 18B generally parallel to the first spring arm 18A, and a third spring arm 18C generally parallel to the second spring arm 18B. The free ends 22 of the first, second and third spring arms 18A-18C are interconnected by a cross bar 28 that is in contact with the inner surface 26 of the shield body 12 within the shield cavity 24.

As best shown in FIG. 3, each spring arm 18 in the plurality of cantilevered spring arms 18 is opposite another spring arm 18 in the plurality of cantilevered spring arms 18.

As shown in FIGS. 1-3, the shield 10 further includes a longitudinal contact rib 30 that is embossed in the shield body 12 and projects from the inner surface 26 into the shield cavity 24.

Figure 4:
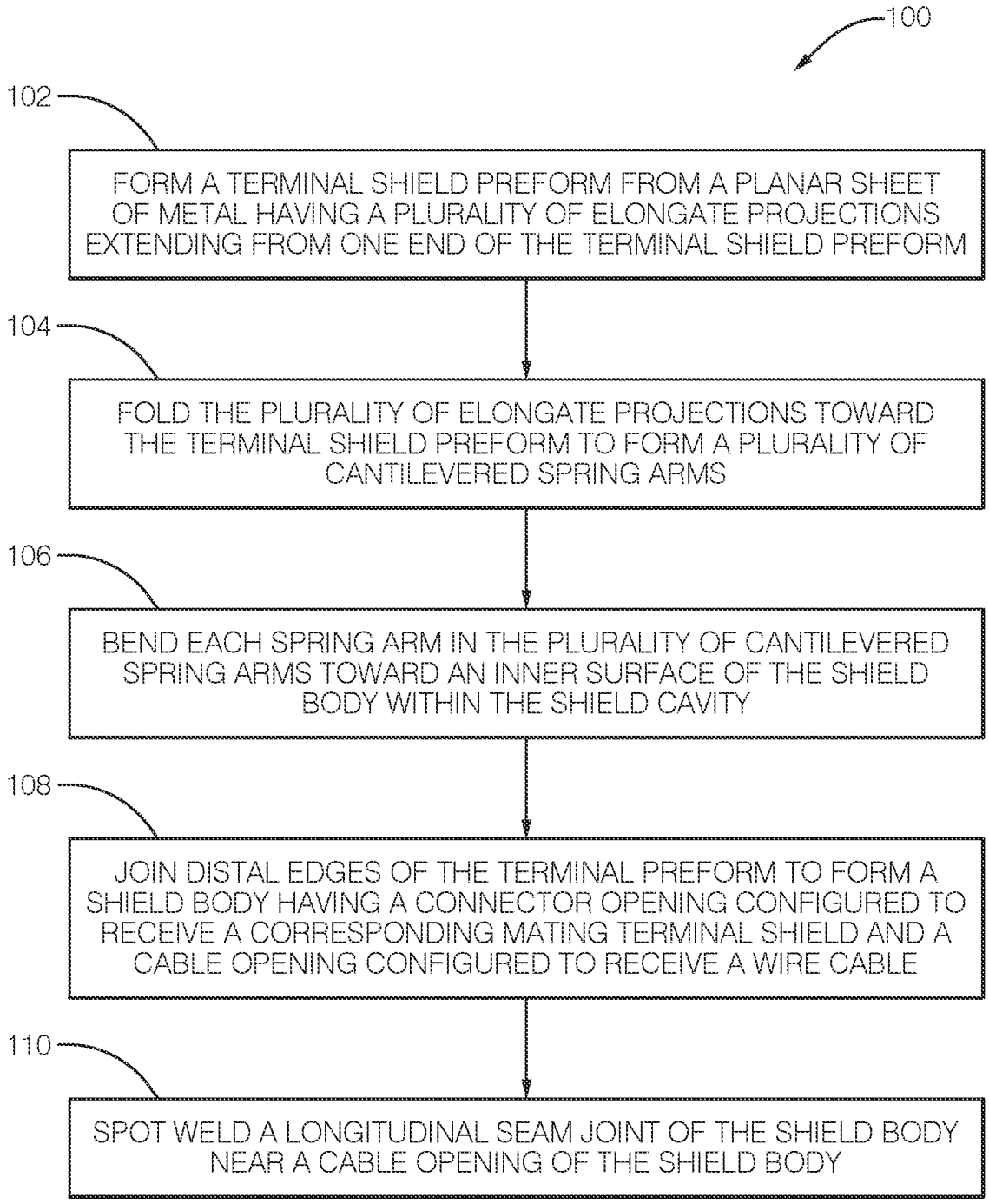
FIG. 4 is a flowchart of a process for manufacturing the electromagnetic terminal shield of FIG. 1, according to another embodiment of the invention.

FIG. 4 illustrates the steps of a process 100 for manufacturing the shield 10 described above. The process 100 includes the following steps:

STEP 102, FORM A TERMINAL SHIELD PREFORM, includes forming a terminal shield preform from a planar sheet of metal having a plurality of elongate projections extending longitudinally from one end of the terminal shield preform. The preform may be cut from the sheet metal using stamping, blanking, laser cutting, waterjet cutting, or any other sheet metal cutting process known to those skilled in the art;

STEP 104, FOLD ELONGATE PROJECTIONS TOWARD THE TERMINAL SHIELD PREFORM, includes folding the plurality of elongate projections toward the terminal shield preform to form a plurality of cantilevered spring arms 18. In the illustrated embodiment, the plurality of cantilevered spring arms 18 includes a first spring arm 18A, a second spring arm 18B generally parallel to the first spring arm 18A, and a third spring arm 18C generally parallel to the second spring arm 18B. The free ends 22 of the first, second and third spring arms 18A-18C are interconnected by a cross bar 28. Other embodiments may include a different configuration of the plurality of cantilevered spring arms 18;

STEP 106, BEND EACH SPRING ARM TOWARD AN INNER SURFACE, is an optional step that includes folding the plurality of elongate projections toward the terminal shield preform to form a plurality of cantilevered spring arms 18. STEP 106 is preferably performed prior to STEP 108; and STEP 108, JOIN DISTAL EDGES OF THE TERMINAL PREFORM TO FORM A SHIELD BODY, includes joining distal edges of the terminal preform by rolling the terminal preform to form a tubular shield body 12 having a connector opening 14 configured to receive a corresponding mating terminal shield and a cable opening 16 configured to receive a wire cable. The plurality of cantilevered spring arms 18 is integrally formed with the shield body 12 and has fixed ends 20 that are attached to the connector opening 14 and free ends 22 that are disposed within a shield cavity 24 defined by the shield body 12. Other embodiments may have a shield body that is rectangular, square, or any other desired shape.

Accordingly, an electromagnetic terminal shield 10 and a process 100 of manufacturing the shield 10 is provided. The different spring rates of the first, second and third spring arms 18A-18C on each side of the shield 10 results in six independent and compliant contact points between the shield 10 and the corresponding mating terminal shield. The shield 10 provides low engage forces but high normal contact forces to provide easy connection and high connection performance. The spring arms 18 contact the shield body 12 at the front and near the rear of the shield body 12, thereby providing improves flow of energy in the shield 10 and optimal electromagnetic compliance (EMC) performance.

The shield 10 provides three different spring rates as the mating electromagnetic terminal shield is engaged with the shield 10. The three spring rates are provided by 1) a cantilevered spring arm 18, 2) a spring arm 18 forming a simply supported beam once the free end 22 of the spring arm 18 engages the inner surface 26 of the shield body 12, and 3) the radial spring of the shield body 12 itself. As the mating electromagnetic terminal shield is inserted into the shield body 12, a first spring rate is provided when the mating electromagnetic terminal shield engages the spring arm 18 when the free end 22 is away from the inside surface of the shield 10. This provides a lower initial engagement force. A second spring rate is provided when the free end 22 of the spring arm 18 engages the inner surface 26 it becomes a simply supported beam. This provides a higher normal force once the initial alignment is mostly completed and the engagement force is mainly due to friction. The third spring rate is provided by the radial hoop shape of the shield 10 itself and the axial location of a spot weld 32 on the seam joint 34 of the shield body 12 near the cable opening 16. This allows for greater tolerance in the connector opening 14. A smaller connector opening 14 provides more interference with the mating electromagnetic terminal shield and results in a higher engagement force. Before the engagement force gets too high, the shield body 12 will flex and the seam joint 34 will open instead.

The contact rib 30 provides stabilization of the shield 10 and improved normal force. Forming the spring arms 18 by folding projection back into the shield cavity 24 of the shield body 12 eliminates openings in the shield body 12 that improves EMC performance and increases contact protection.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electromagnetic terminal shield, comprising:

a shield body formed of sheet metal having a connector opening configured to receive a corresponding mating terminal shield and a cable opening configured to receive a wire cable; and a plurality of cantilevered spring arms integrally formed with the shield body having fixed ends attached to the connector opening and free ends disposed within a shield cavity defined by the shield body, wherein each spring arm in the plurality of cantilevered spring arms has a free end that is in contact with an inner surface of the shield body within the shield cavity, wherein the plurality of cantilevered spring arms includes a first spring arm, a second spring arm generally parallel to the first spring arm, and a third spring arm generally parallel to the second spring arm and wherein the free ends of the first, second and third spring arms are interconnected by a cross bar that is in contact with the inner surface of the shield body within the shield cavity.

2. The electromagnetic terminal shield according to claim 1, wherein each spring arm in the plurality of cantilevered spring arms is bent toward an inner surface of the shield body within the shield cavity.

3. The electromagnetic terminal shield according to claim 1, wherein each spring arm in the plurality of cantilevered spring arms is opposite another spring arm in the plurality of cantilevered spring arms.

4. The electromagnetic terminal shield according to claim 1, wherein the shield body defines a longitudinal seam joint and wherein the seam joint is spot welded near a cable opening.

5. A process for manufacturing an electromagnetic terminal shield, comprising the steps of:

forming a terminal shield preform from a planar sheet of metal having a plurality of elongate projections extending from one end of the terminal shield preform;

folding the plurality of elongate projections toward the terminal shield preform to form a plurality of cantilevered spring arms; and joining distal edges of the terminal preform to form a shield body having a connector opening configured to receive a corresponding mating terminal shield and a cable opening configured to receive a wire cable, wherein the plurality of cantilevered spring arms is integrally formed with the shield body having fixed ends attached to the connector opening and free ends disposed within a shield cavity defined by the shield body, wherein each spring arm in the plurality of cantilevered spring arms has a free end that is in contact with an inner surface of the shield body within the shield cavity, wherein the plurality of cantilevered spring arms includes a first spring arm, a second spring arm generally parallel to the first spring arm, and a third spring arm generally parallel to the second spring arm and wherein the free ends of the first, second and third spring arms are interconnected by a cross bar that is in contact with the inner surface of the shield body within the shield cavity.

6. The process according to claim 5, wherein the process further includes the step of: bending each spring arm in the plurality of cantilevered spring arms toward an inner surface of the shield body within the shield cavity.

7. The process according to claim 5, wherein each spring arm in the plurality of cantilevered spring arms is opposite another spring arm in the plurality of cantilevered spring arms.

8. The process according to claim 5, wherein the process further includes the step of: spot welding a longitudinal seam joint of the shield body near a cable opening of the shield body.

9. An electromagnetic terminal shield manufactured by a process, comprising the steps of:

forming a terminal shield preform from a planar sheet of metal having a plurality of elongate projections extending from one end of the terminal shield preform;

folding the plurality of elongate projections toward the terminal shield preform to form a plurality of cantilevered spring arms; and joining distal edges of the terminal preform to form a shield body having a connector opening configured to receive a corresponding mating terminal shield and a cable opening configured to receive a wire cable, wherein the plurality of cantilevered spring arms is integrally formed with the shield body having fixed ends attached to the connector opening and free ends disposed within a shield cavity defined by the shield body, wherein each spring arm in the plurality of cantilevered spring arms has a free end that is in contact with an inner surface of the shield body within the shield cavity, wherein the plurality of cantilevered spring arms includes a first spring arm, a second spring arm generally parallel to the first spring arm, and a third spring arm generally parallel to the second spring arm and wherein the free ends of the first, second and third spring arms are interconnected by a cross bar that is in contact with the inner surface of the shield body within the shield cavity.

10. The electromagnetic terminal shield according to claim 9, wherein the process further includes the step of: bending each spring arm in the plurality of cantilevered spring arms toward an inner surface of the shield body within the shield cavity.

11. The electromagnetic terminal shield according to claim 9, wherein each spring arm in the plurality of cantilevered spring arms is opposite another spring arm in the plurality of cantilevered spring arms.

12. The electromagnetic terminal shield according to claim 9, wherein the process further includes the step of: spot welding a longitudinal seam joint of the shield body near a cable opening of the shield body.

* * * * *